US006771922B2

(12) United States Patent
Blanck et al.

(10) Patent No.: US 6,771,922 B2
(45) Date of Patent: Aug. 3, 2004

(54) TONER CARTRIDGE

(75) Inventors: Thomas Wilbur Blanck, Nicholasville, KY (US); Mark Duane Foster, Lexington, KY (US); Robert Watson McAlpine, Lexington, KY (US); Gregory Scott Tigges, Frankfort, KY (US)

(73) Assignee: Lexmark International, Inc., Lexington, KY (US)

( * ) Notice: Subject to any disclaimer, the term of this patent is extended or adjusted under 35 U.S.C. 154(b) by 58 days.

(21) Appl. No.: 10/335,340

(22) Filed: Dec. 31, 2002

(65) Prior Publication Data

US 2004/0126143 A1 Jul. 1, 2004

(51) Int. Cl.[7] ..... G03G 15/08
(52) U.S. Cl. ..... 399/260; 399/119; 399/254
(58) Field of Search ..... 399/260, 258, 399/256, 254, 262, 119, 120; 222/DIG. 1

(56) References Cited

U.S. PATENT DOCUMENTS

| | | | | | |
|---|---|---|---|---|---|
| 4,993,829 | A | * | 2/1991 | Naganuma et al. | 399/260 |
| 5,875,378 | A | | 2/1999 | Campbell et al. | |
| 6,181,904 | B1 | * | 1/2001 | Burdette et al. | 399/260 |
| 6,229,976 | B1 | * | 5/2001 | Kimura | 399/262 |
| 6,459,876 | B1 | * | 10/2002 | Buchanan et al. | 399/254 |

FOREIGN PATENT DOCUMENTS

JP 04-342274 * 11/1992

* cited by examiner

*Primary Examiner*—Sophia S. Chen
(74) *Attorney, Agent, or Firm*—John A. Brady

(57) ABSTRACT

A toner cartridge for use in a laser printer has a toner reservoir or hopper in which an agitator is pivoted by a rotating paddle away from its home position proximate an exit opening and then returned to its home position by a spring exerting a predetermined desired force on the agitator after the agitator ceases to be moved by the paddle. The spring may be a cantilever spring, a torsion spring, or a stamped and formed leaf spring.

9 Claims, 14 Drawing Sheets

TONER CARTRIDGE

FIELD OF THE INVENTION

This invention relates to an improved toner cartridge for use in a laser printer and, more particularly, to a toner cartridge for use in a laser printer utilizing an arrangement for improving print quality and print speed.

BACKGROUND OF THE INVENTION

Print quality in a laser printer is improved when the size of the toner particles is reduced. This size reduction of the particles allows more of the particles to print in a specific area so that there is more overlapping of the particles during development of an image on a medium such as paper, for example.

It also is desired to increase print speed. This results in the need for a lower melt point toner so that the toner will fuse faster on the medium.

Lower melt point toners are more prone to clumping to make it more difficult to convey the toner from its supply hopper or reservoir to the image development zone of the laser printer. This is because lower melt point toners have inherently lower flow rates than previously employed toners with higher melt point temperatures.

Inadequate conveyance of the lower melt point toner due to its lower flow rates can lead to insufficient toner in the image development zone; this reduces print quality even though the size of the toner particles has been decreased to improve the print quality. This insufficient toner in the development zone is referred to as "toner starvation."

Various mechanical arrangements have been employed to aid in conveyance of the toner. These include rotating rods, reciprocating rakes, gravity assisted inclines, and a pivotally mounted agitator, for example.

U.S. Pat. No. 5,875,378 to Campbell et al discloses an agitator pivotally mounted about its end points and located in a transition opening between the supply hopper and the image development zone. The agitator is driven upwardly by a rotating paddle, which passes through the toner in the supply hopper, to a point at which their curved paths separate. Then, the agitator falls by gravity until it returns to its home or rest position, which is proximate to an exit surface sloping downwardly during normal operation of the toner cartridge.

Falling of the agitator by gravity displaces toner in the transition zone, which is between the hopper and the image development zone, into the image development area because of the sweeping motion of the agitator. The weight of the agitator is employed to break up the particles of toner that tend to clump together.

When using a lower melt point toner, the agitator is eventually suspended upon a bed of toner through its repeated actuation by the toner paddle. As a result, the agitator has been found to be ineffective for causing transport of toner particles having a lower melt point. It has been discovered that an external tip load on the farthest reaching portion of the agitator requires 20–50 grams of force on the agitator to return it to its home or rest position when using a lower melt point toner.

This problem is solved through using resilient means such as a spring, for example, to provide an additional tip loading of 20–50 grams on a pivotally mounted agitator. This enables the improved toner cartridge to have a lower melt point toner for increased printing speeds while using particles of relatively smaller size to improve the print quality. Therefore, premature failure to print, which is termed "toner starvation," is avoided.

SUMMARY OF THE INVENTION

A toner cartridge comprises a hopper having an opening for delivering toner out of the hopper, which has a lower wall extending from a bottom of the hopper to a location substantially above the bottom of the hopper to define a bottom of the opening. A paddle is rotatable in the hopper to stir toner such that some toner will move gently toward the opening. The cartridge also has an exit surface to deliver toner from the hopper on the side of the lower wall opposite the hopper with the exit surface sloping downwardly during normal operation of the cartridge. An agitator, which extends across the exit surface, has a first pivot member on one side of the exit surface and a second pivot member on an opposite side of the exit surface. The hopper has support pins for supporting the first pivot member and the second pivot member of the agitator to pivotally support the agitator on the hopper. The agitator is normally located at a home position proximate the exit surface except when moved by the paddle around the first pivot member and the second pivot member. An extension on the agitator extends past the lower wall into the path of the paddle in the hopper when the paddle is rotated. Resilient means mounted on the agitator exerts a force on the agitator to return the agitator to the home position after the agitator is moved from the home position by the paddle engaging the extension during rotation of the paddle and the paddle ceases to engage the extension.

BRIEF DESCRIPTION OF THE DRAWINGS

The attached drawings illustrate exemplary embodiments of the invention, in which.

DETAILED DESCRIPTION OF EXEMPLARY EMBODIMENTS

Figure 1:
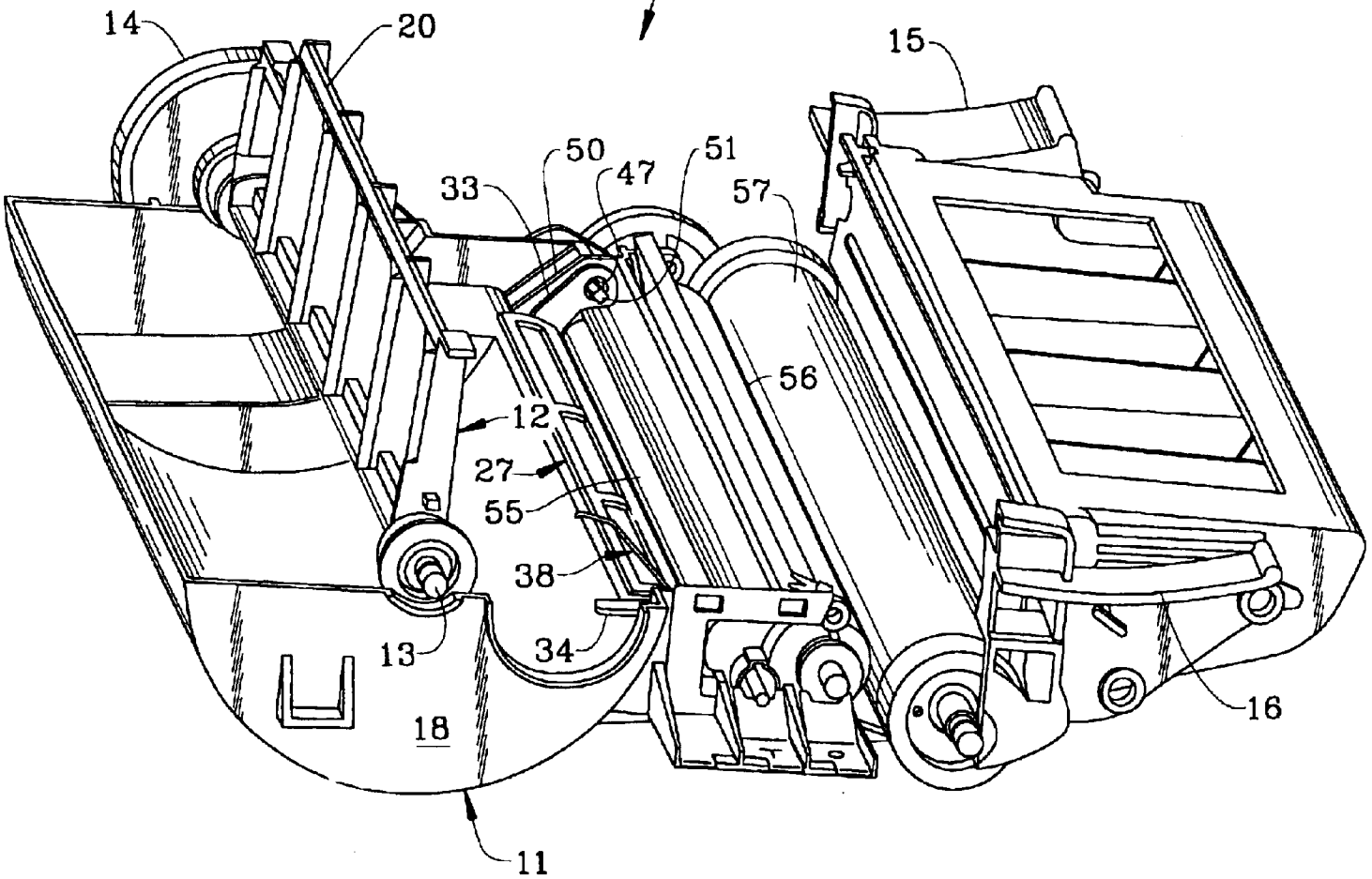
FIG. 1 is a top right front perspective view of a toner cartridge of a laser printer where right is determined facing the laser printer from its front side where insertion of the toner cartridge is made with cover elements removed.

Referring to the drawings and particularly FIG. 1, there is shown a toner cartridge 10 for use in a laser printer. The toner cartridge 10 is inserted into the laser printer from the front and removable therefrom in the well-known manner.

The toner cartridge 10 includes a hopper 11 within which a paddle 12 is rotatably supported and driven by a drive element in the laser printer through a gear train including a gear 14 attached to a shaft 13 of the paddle 12. The paddle 12 is rotated counterclockwise (as viewed in FIG. 1).

Figure 2:
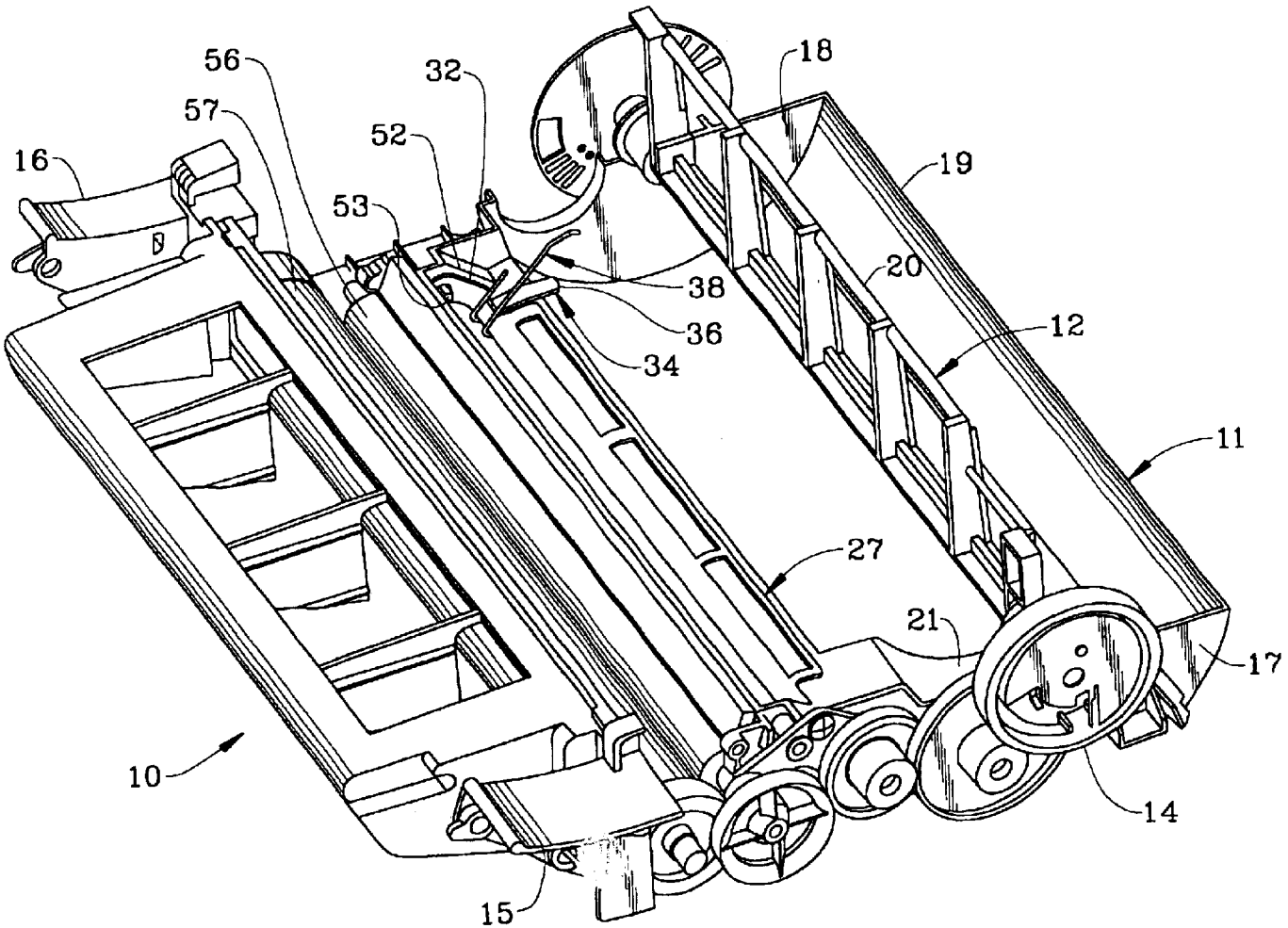
FIG. 2 is a top left rear perspective view of the cartridge with cover elements removed.

To facilitate and guide insertion of the cartridge 10 into the laser printer, the cartridge 10 has a left guide wing 15 (see FIG. 2) and a right guide wing 16. The guide wings 15 and 16 are mirror images of each other except that the left guide wing 15 is wider to accommodate the width provided by a particular printer in which the cartridge 10 is to be installed.

The hopper 11 includes a left end wall 17 and a right end wall 18 connected to opposite ends of a housing 19 of the hopper 11 to form a toner reservoir.

The paddle 12 has an outer toner moving bar 20. The bar 20 extends across the width of the housing 19 except for a far left section 21, which is inset for manufacturing purposes.

Figure 3:
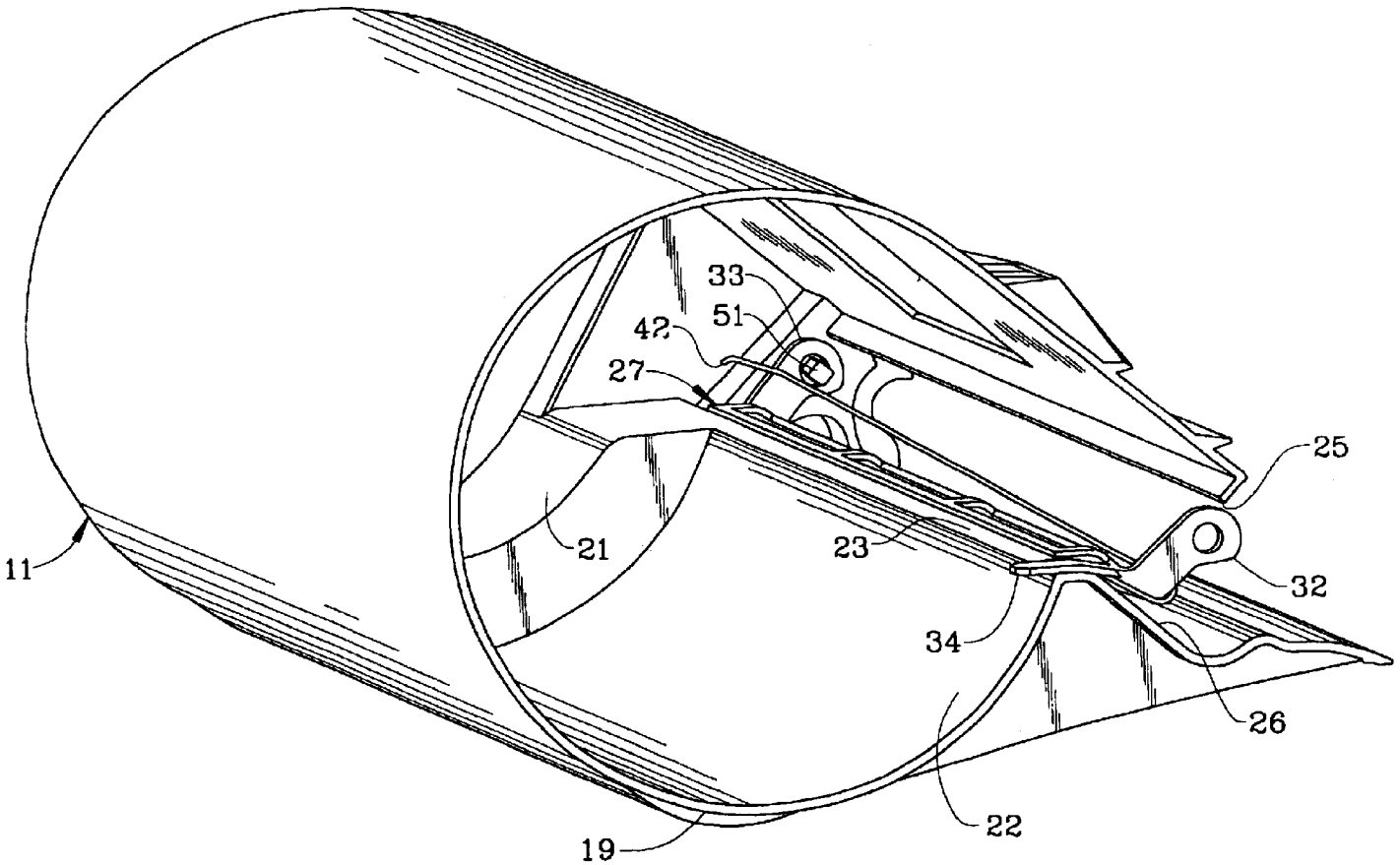
FIG. 3 is a front right perspective view of a hopper with one of its end walls removed and showing a spring used to return a toner agitator to its home position after it has been advanced therefrom by a rotatable paddle.

A rear wall 22 (see FIG. 3) of the hopper housing 19 terminates at about one-third of the total height of the interior of the hopper housing 19 as a flat surface 23. The flat surface 23 has a slight downward angle from the hopper 11.

An exit opening from the interior of the hopper 11 is defined by the flat surface 23 and a top wall 25 of the hopper 11. An exit surface or wall 26 extends from the flat surface 23 of the rear wall 22 at an angle of approximately 50°. The exit surface or wall 26 is flat.

Figure 12:
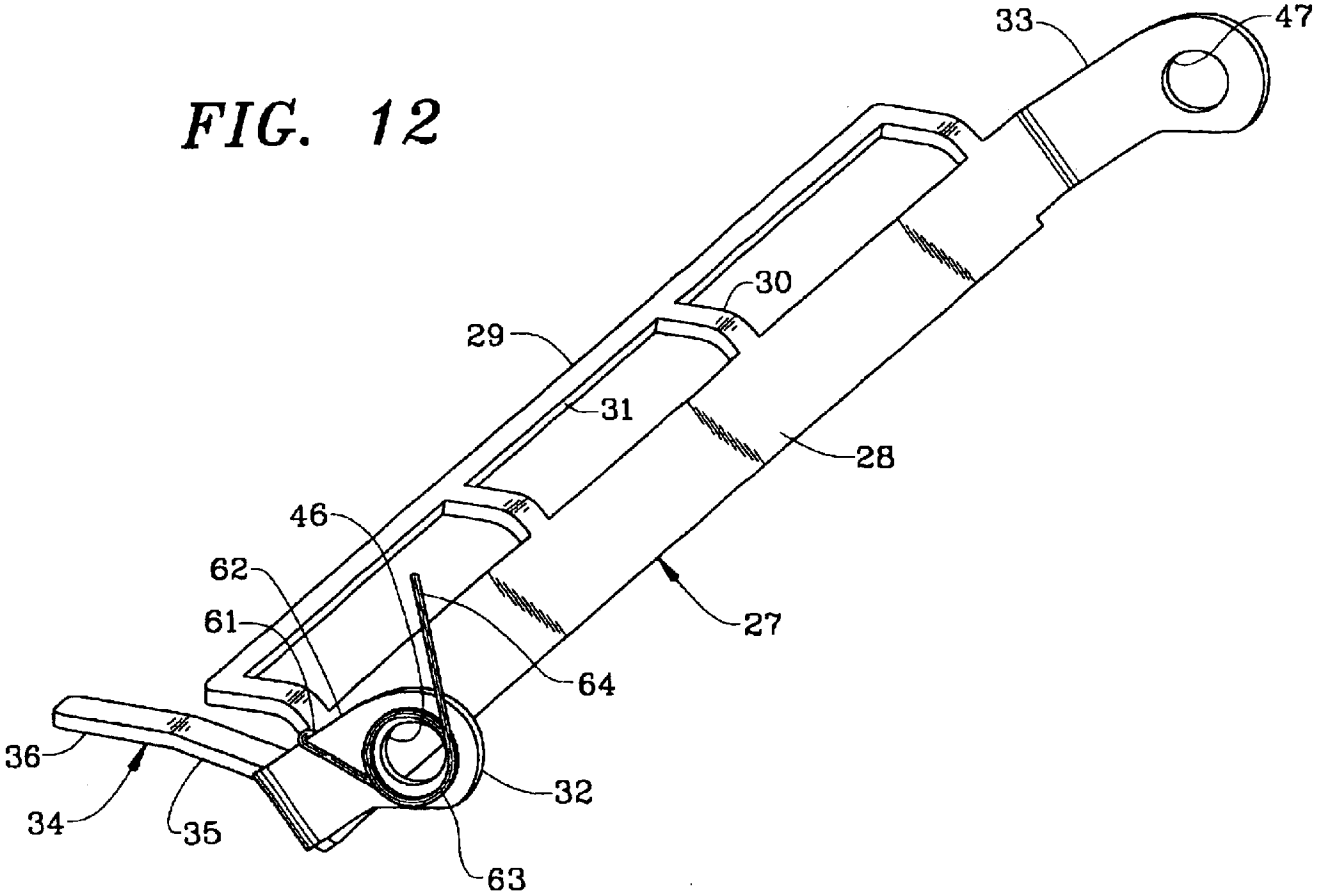
FIG. 12 is a perspective view of the agitator with the torsion spring of FIG. 11 mounted thereon.

An agitator 27 extends across the flat surface 23. As shown in FIG. 12, the agitator 27 includes a first body portion 28 and a second body portion 29 spaced from the first body portion 28 and connected thereto by connectors 30 to produce rectangular shaped openings 31. The second body portion 29 is at an angle to the first body portion 28.

The first body portion 28 has arms 32 and 33 integral therewith at its ends and extending therefrom. The arm 32 extends substantially perpendicular to the first body portion 28, and the arm 33 is an angle greater than 90° to the first body portion 28 of the agitator 27.

An extension 34 extends from the first body portion 28 of the agitator 27 at the end adjacent the arm 32. The extension 34 includes a first portion 35 extending downwardly from the first body portion 28 of the agitator 27 and a second portion 36 inclined downwardly from the first portion 35.

Figure 4:
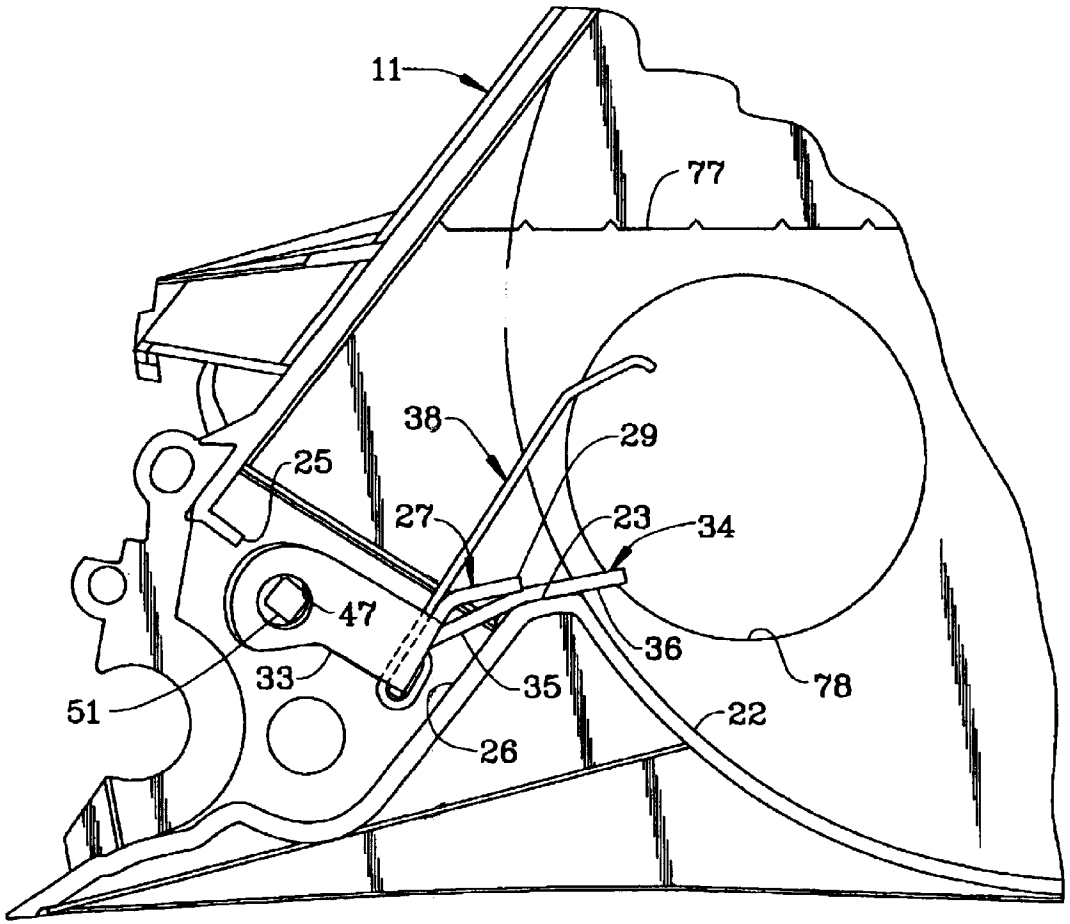
FIG. 4 is an end elevational view of a poi lion of the hopper with one of its end walls removed and the agitator in its home position.

As shown in FIG. 4, the second portion 36 of the extension 34 rests on the flat surface 23 of the rear wall 22 of the hopper 11. This positions the agitator 27 slightly above the flat surface 23 of the rear wall 22 of the hopper 11.

Figure 6:
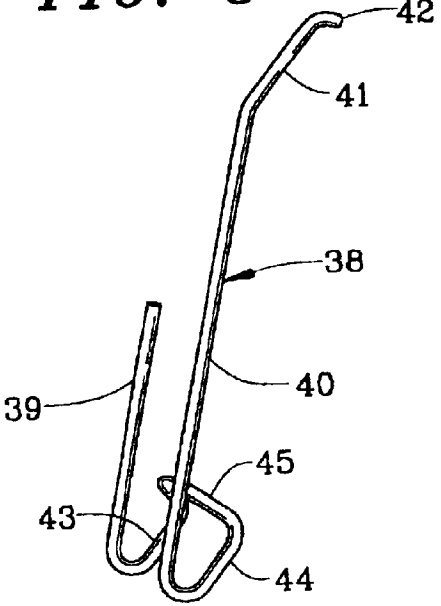
FIG. 6 is a perspective view of the spring employed to return the agitator to its home position.
Figure 10:
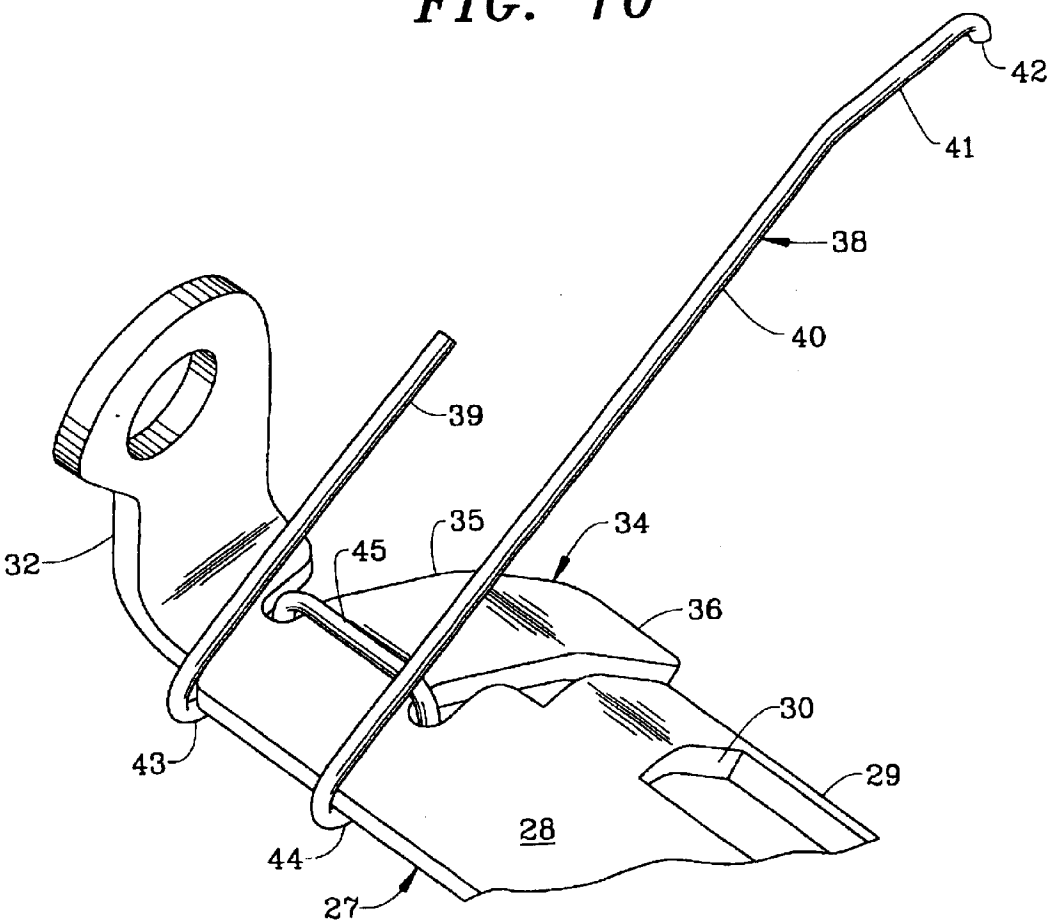
FIG. 10 is a perspective view, similar to FIGS. 7–9, of a portion of the agitator and showing the spring fully rotated to its assembled position on the agitator.

A cantilever spring 38 (see FIG. 6), which is formed of a music wire preferably having a diameter of 0.016", is mounted on the first body portion 28 (see FIG. 10) of the agitator 27. The spring 38 (see FIG. 6) includes a short leg 39 and a long leg 40. An inclined portion 41 extends from the top of the long leg 40 and terminates in a curved portion 42.

The legs 39 and 40, which are substantially parallel to each other, are connected to each other by a base including a portion 43 extending from the short leg 39 and a portion 44 extending from the long leg 40. The portions 43 and 44 are connected to each other by a portion 45 to form the base of the spring 38.

Figure 7:
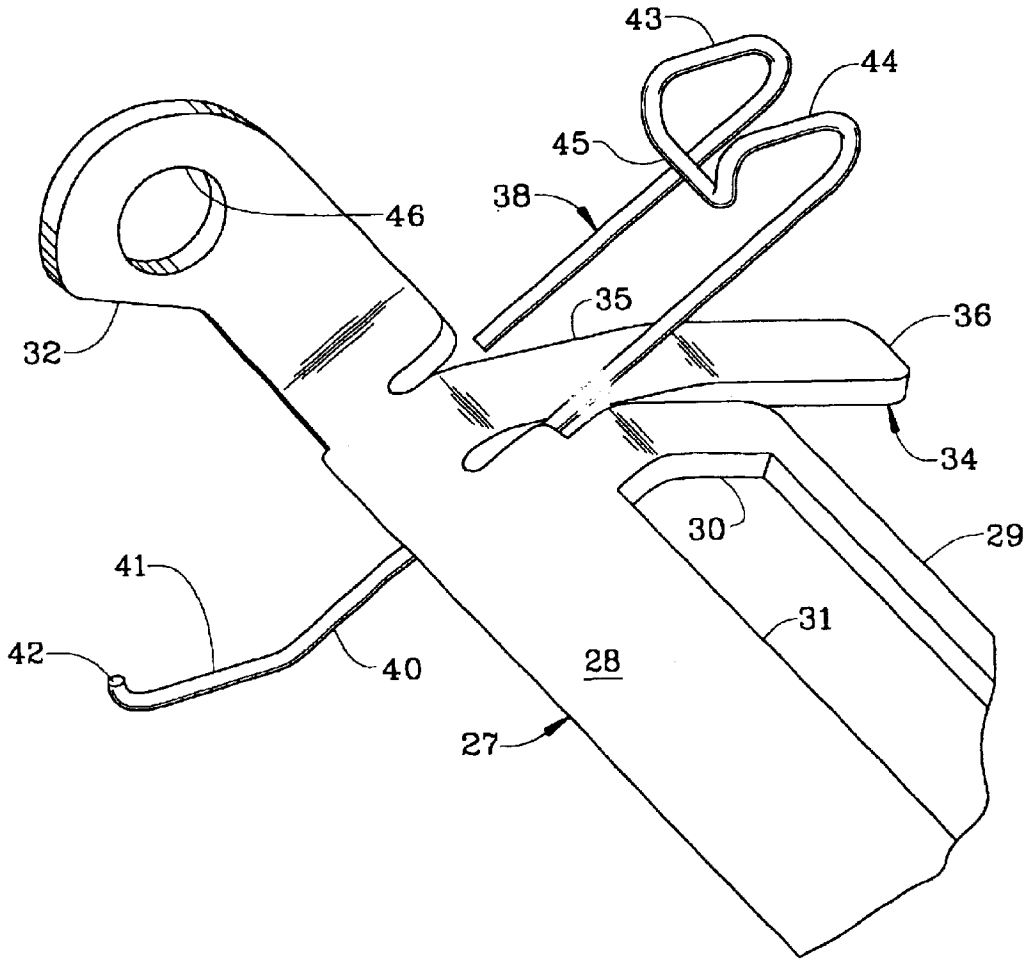
FIG. 7 is a perspective view of a portion of the agitator and showing initial positioning of the spring of FIG. 6 on the agitator.
Figure 8:
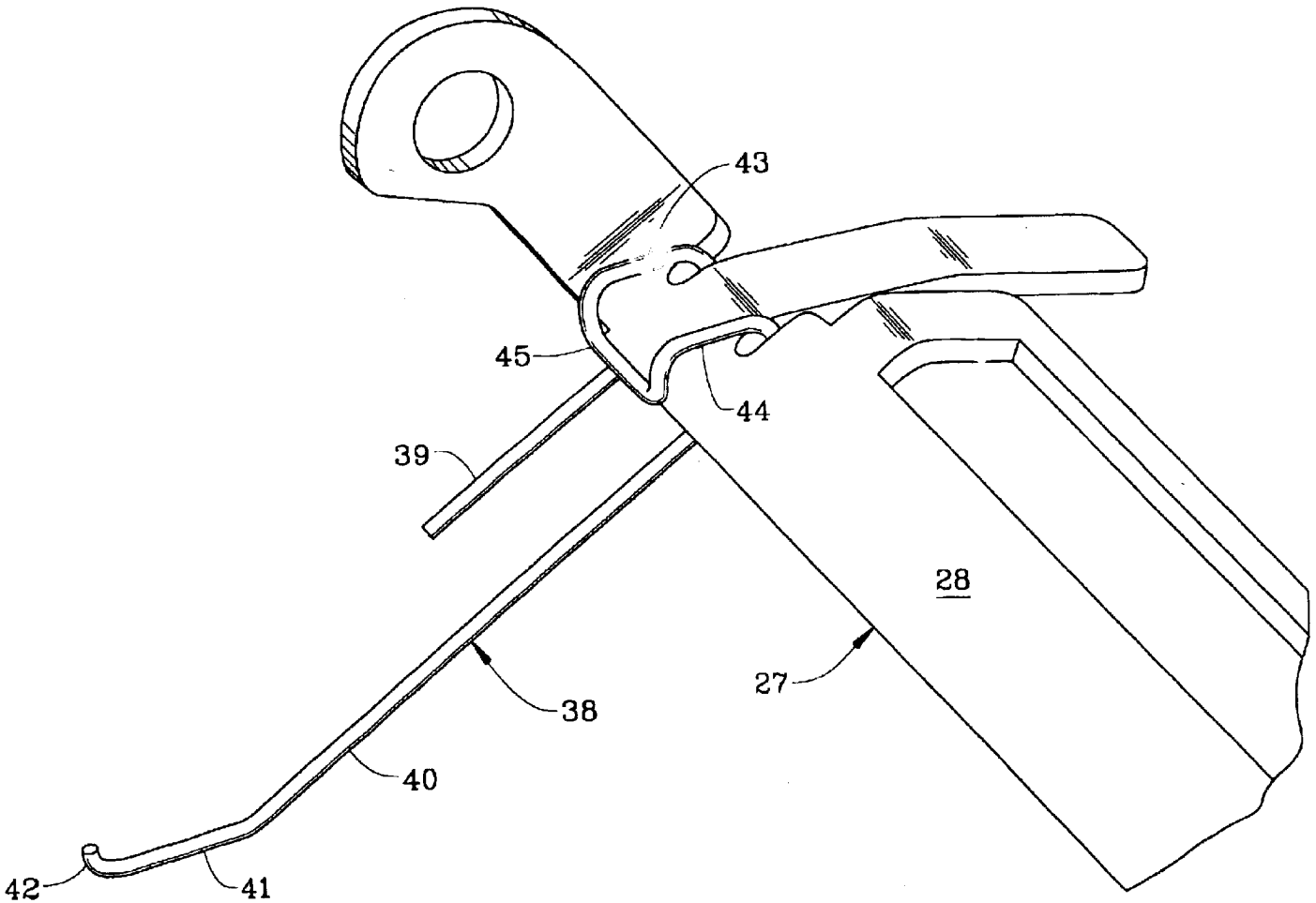
FIG. 8 is a perspective view, similar to FIG. 7, of a portion of the agitator and showing the spring pulled onto the agitator.
Figure 9:
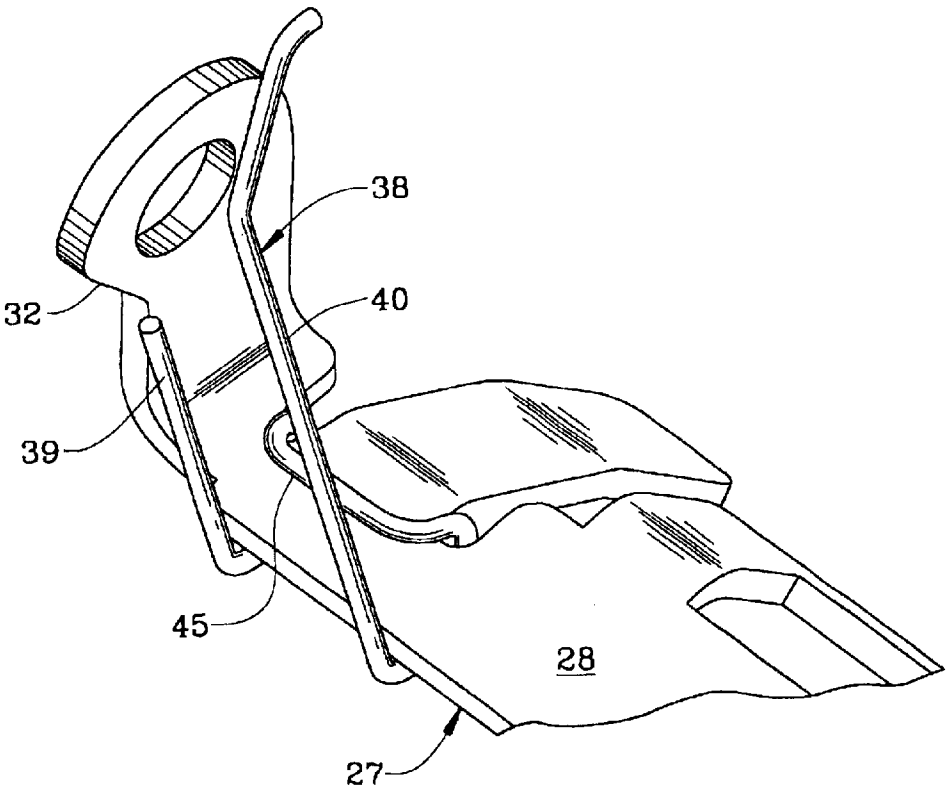
FIG. 9 is a perspective view, similar to FIGS. 7 and 8, of a portion of the agitator and showing the spring partially rotated from the position of FIG. 8.

As shown in FIG. 7, the spring 38 is initially positioned with the long leg 40 beneath the first body portion 28 of the agitator 27. The spring 38 is then pulled from the position of FIG. 7 to the position of FIG. 8 in which the portion 45 extends over the first body portion 28 of the agitator 27. Next, the spring 38 is rotated to the position of FIG. 9. Finally, further rotation of the spring 38 from the position of FIG. 9 to the position of FIG. 10 mounts the spring 38 in the desired position on the agitator 27. This uniquely wrapped base of the portions 43–45 of the spring 38 eliminates the need for any fastener or retainer for assembly of the spring 38 on the agitator 27.

The arm 32 (see FIG. 12) of the agitator 27 has a circular opening 46. The arm 33 of the agitator 27 has a circular opening 47.

The left end wall 17 (see FIG. 2) of the hopper 11 has an extension 50 (see FIG. 1) with a rectangular shaped post or pin 51 extending substantially perpendicular therefrom for disposition in the circular opening 47 in the arm 33 of the agitator 27. The right end wall 18 (see FIG. 2) of the hopper 11 has an extension 52 with a rectangular shaped post or pin 53 extending substantially perpendicular therefrom for disposition in the circular opening 46 (see FIG. 7) in the arm 32 of the agitator 27.

Figure 5:
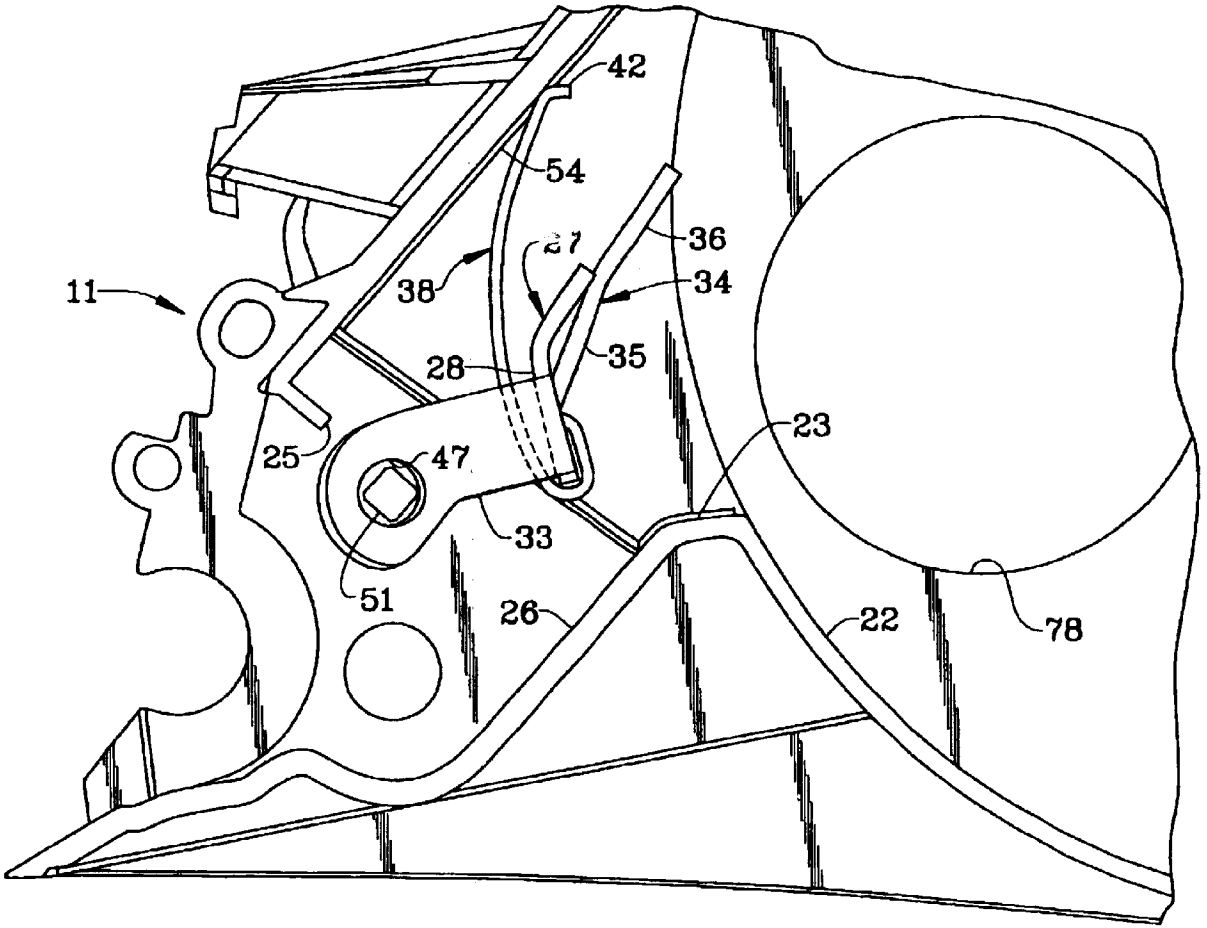
FIG. 5 is an end elevational view of a portion of the hopper, similar to FIG. 4, with the one end wall removed and the agitator in its raised position and the spring engaged with an interior surface of the hopper.

The shape of the post 53 (see FIG. 2), which is the same as the shape of the post 51 (see FIG. 1), is clearly shown in FIG. 5 even though it is not actually disposed in the circular opening 47 in the arm 33 but is disposed in the circular opening 46 (see FIG. 12) in the arm 32. This is because the left end wall 17 (see FIG. 2) of the hopper 11 including the extension 50 and the post 51 has been removed from FIG. 5.

Accordingly, the agitator 27 is pivotally mounted for movement from the position of FIG. 4 to the position of FIG. 5 by the bar 20 (see FIG. 2) of the paddle 12 engaging the second portion 36 (see FIG. 4) of the extension 34 of the agitator 27 to move it to the position of FIG. 5. When the curved portion 42 of the spring 38 engages interior surface 54 of the hopper 11, the bar 20 (see FIG. 2) of the paddle 12 has ceased to engage the extension 34 of the agitator 27.

Then, the spring 38 exerts a force of 20–50 grams on the agitator 27 to pivot it from the position of FIG. 5 to the position of FIG. 4. This results in the agitator 27 moving the toner through the exit opening, which is between the flat surface 23 of the rear wall 22 of the hopper 11 and the top wall 25 of the hopper 11. This causes the toner to move along the downwardly inclined exit surface or wall 26.

Thus, the agitator 27 prevents toner stagnation and delivers toner to a toner adder roller 55 (see FIG. 1). The toner adder roller 55 is adjacent a developer roller 56, which is adjacent a photoconductor drum 57.

Figure 11:
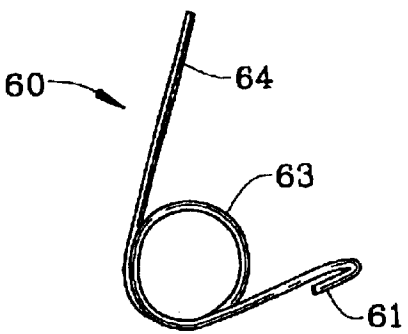
FIG. 11 is a perspective view of a torsion spring employed to return the agitator to its home position.

Accordingly, the spring 38 exerts the predetermined desired force on the agitator 27 to return it to its home position which is proximate the exit surface or wall 26 (see FIG. 4). Instead of using the spring 38, which is formed of music wire, a torsion spring 60 (see FIG. 11) may be employed, if desired, to return the agitator 27 (see FIG. 5) from the position of FIG. 5 to the position of FIG. 4.

Figure 13:
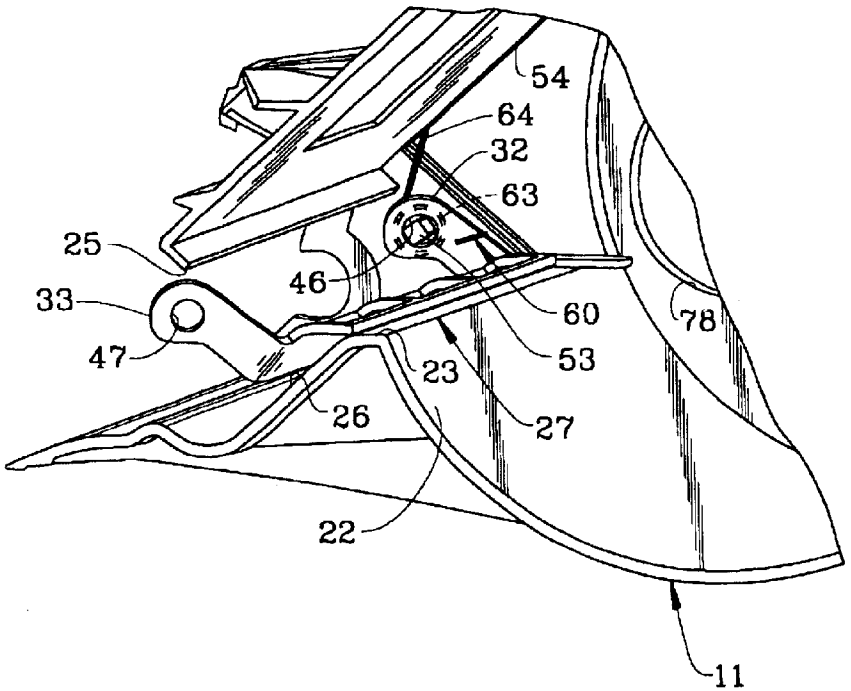
FIG. 13 is a front left perspective view of a portion of the hopper with the agitator having the torsion spring of FIG. 11 mounted thereon.

The torsion spring 60 (see FIG. 11) includes a hooked end 61 for fitting around a surface 62 (see FIG. 12) of the arm 32 of the agitator 27. The torsion spring 60 has a coiled portion 63, which is supported on the post 53 (see FIG. 13), surrounding the opening 46 in the arm 32 and a free end 64 (see FIG. 12). As shown in FIG. 13, the free end 64 of the torsion spring 60 engages the interior surface 54 of the hopper 11 in the same manner as the curved portion 42 (see FIG. 5) of the spring 38 engages the interior surface 54 of the hopper 11 when the paddle 12 (see FIG. 1) has advanced the agitator 27 from the position of FIG. 4 to the position of FIG. 5.

Figure 14:
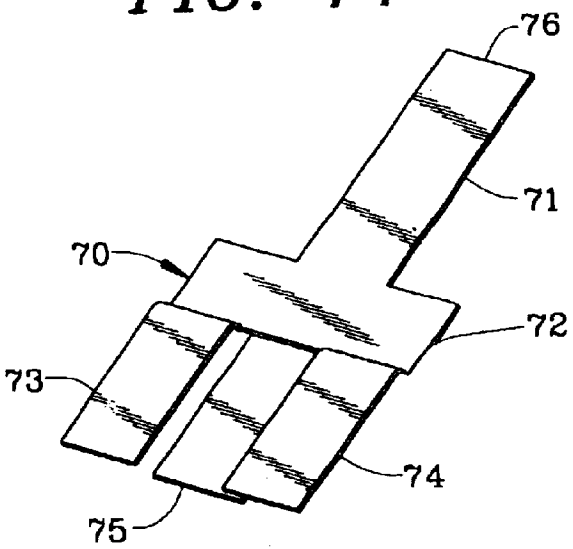
FIG. 14 is a perspective view of a stamped and formed leaf spring utilized for returning the agitator to its home position.

Another resilient means for exerting the predetermined desired force on the agitator 27 to return the agitator 27 to the position of FIG. 5 is to utilize a stamped and formed leaf spring 70 (see FIG. 14). The leaf spring 70 has an elongated portion 71 extending from one end of a base 72. The spring 70 has two fingers 73 and 74 spaced from each other and extending from the other end of the base 72 in a plane above the base 72. A third finger 75 extends from the base 72 in a plane beneath the base 72.

Figure 15:
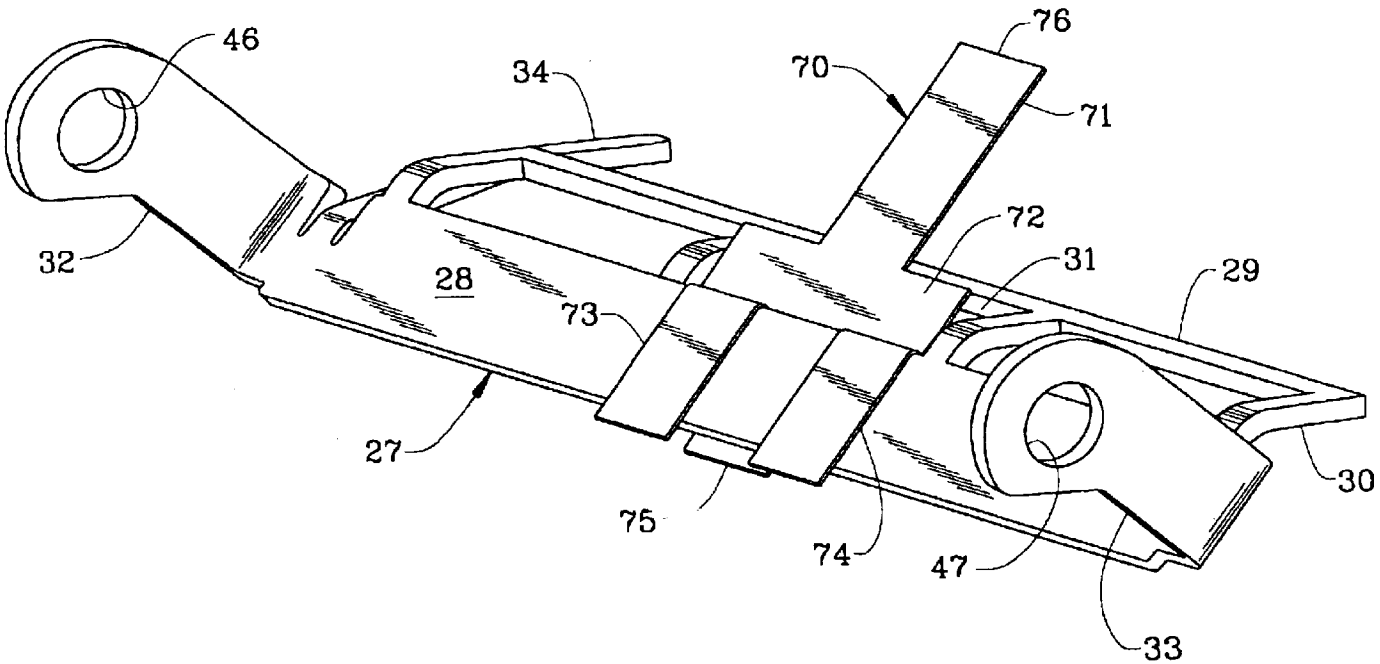
FIG. 15 is a perspective view of the agitator with the stamped and formed leaf spring of FIG. 14 mounted thereon.

As shown in FIG. 15, the fingers 73 and 74 of the spring 70 extend across the top of the first body portion 28 of the agitator 27 while the third finger 75 extends beneath the first body portion 28 of the agitator 27. Thus, this produces a press fit of the spring 70 on the first body portion 28 of the agitator 27.

The base 72 is disposed in the middle of the three openings 31 between two of the connectors 30. The base 72 of the spring 70 may be disposed in either of the other two openings 31, if desired.

Figure 16:
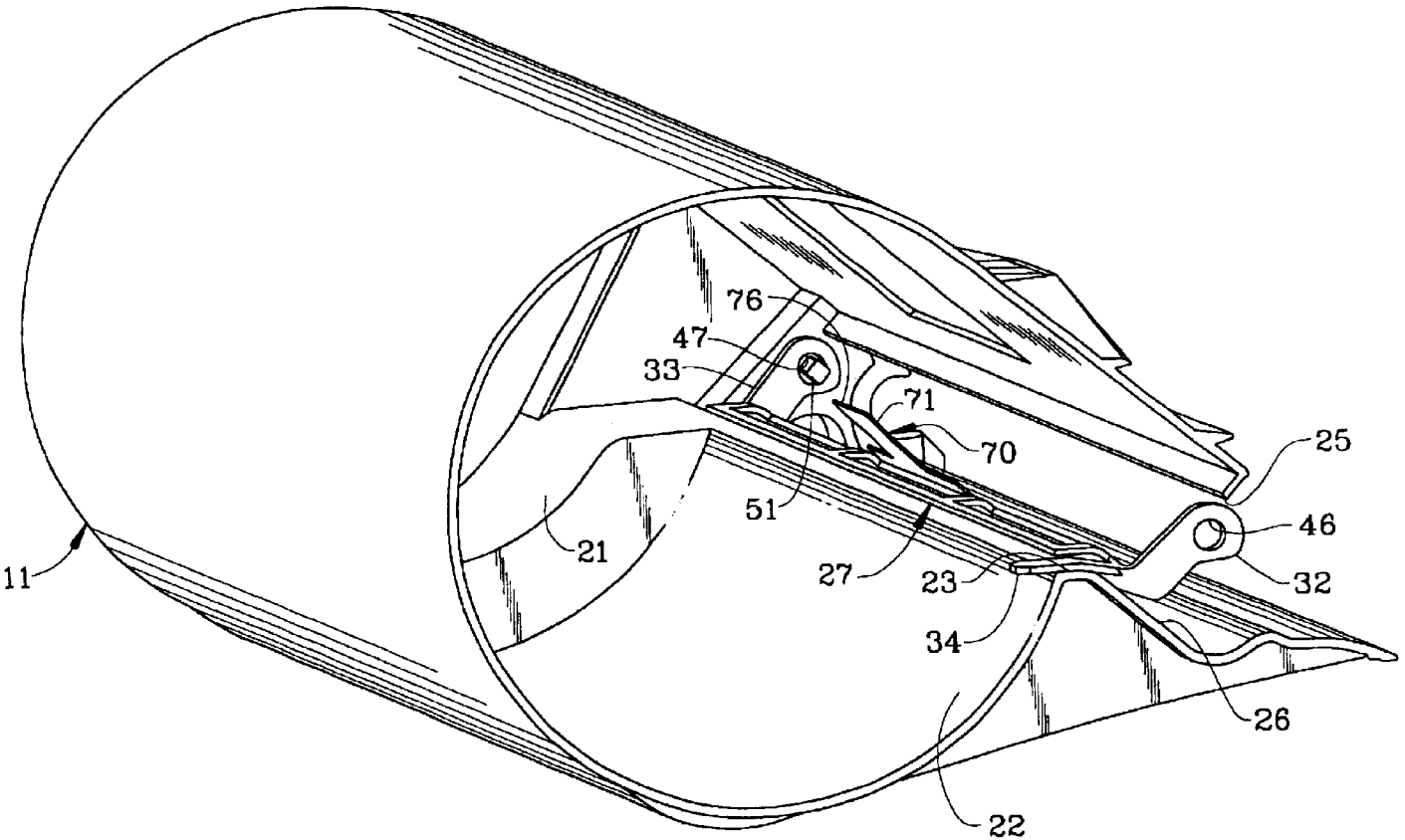
FIG. 16 is a front left perspective view of the hopper with the agitator having the stamped and formed leaf spring of FIG. 14 mounted thereon.

As shown in FIG. 16, the elongated portion 71 of the spring 70 has its end 76 disposed for engagement with the interior surface 54 (see FIG. 5) of the hopper 11 when the agitator 27 is moved to the position of FIG. 5 by the paddle 12 (see FIG. 1). This enables the spring 70 (see FIG. 16) to exert the predetermined desired force on the agitator 27 to return it to its home position.

The appropriate level of toner 77 (see FIG. 4) is schematically indicated by a surface line in FIG. 4, but the toner 77 is otherwise transparent for clarity purposes. The toner 77 is supplied to the interior of the hopper 11 through a fill hole 78, which is closed by a plug.

For purposes of exemplification, exemplary embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A toner cartridge comprising:

a hopper having an opening for delivering toner out of said hopper;

said hopper having a lower wall extending from a bottom of said hopper to a location substantially above the bottom of said hopper to define a bottom of said opening;

a paddle rotatable in said hopper to stir toner such that some toner will move gently toward said opening;

an exit surface to deliver toner from said hopper on the side of said lower wall opposite said hopper, said exit surface sloping downwardly during normal operation of said cartridge;

an agitator extending across said exit surface having a first pivot member on one side of said exit surface and a second pivot member on an opposite side of said exit surface;

said hopper having support pins for supporting said first pivot member and said second pivot member of said agitator to pivotally support said agitator on said hopper;

said agitator normally located at a home position proximal said exit surface except when moved by said paddle around said first pivot member and said second pivot member;

an extension on said agitator extending past said lower wall into the path of said paddle in said hopper when said paddle is rotated;

and a spring mounted for exerting a force on said agitator to return said agitator to said home position after said agitator is moved from said home position by said paddle engaging said extension during rotation of said paddle and said paddle ceases to engage said extension.

2. The toner cartridge according to claim 1 in which said spring is mounted on said agitator and has a portion engaging the interior of said hopper when said agitator is moved from said home position by said paddle engaging said extension during rotation of said paddle to exert force on said agitator to return said agitator to said home position.

3. The toner cartridge according to claim 2 in which said spring is a wire having a free end constituting said portion engaging the interior of said hopper to exert force on said agitator to return said agitator to said home position after said paddle ceases to engage said extension.

4. The toner cartridge according to claim 2 in which said spring is a wire having a base wrapped around said agitator and a leg extending from said base, said leg constituting said portion engaging the interior of said hopper to exert force on said agitator to return said agitator to said home position after said paddle ceases to engage said extension.

5. The toner cartridge according to claim 2 in which said spring is a torsion spring connected to said agitator to exert force on said agitator and having a free end constituting said portion engaging the interior of said hopper when said agitator is moved from said home position by said paddle engaging said extension during rotation of said paddle to exert force on said agitator to return said agitator to said home position after said paddle ceases to engage said extension.

6. The toner cartridge according to claim 2 in which said spring is a stamped and formed leaf spring having an end constituting said portion engaging the interior of said hopper when said agitator is moved from said home position by said paddle engaging said extension during rotation of said paddle to exert force on said agitator to return said agitator to said home position after said paddle ceases to engage said extension.

7. The toner cartridge according to claim 6 in which said stamped and formed leaf spring comprises:

a base having an elongated portion extending from one end thereof;

said elongated portion having its free end constitute said end engaging the interior of said hopper;

and said base having overlapping fingers in two substantially parallel planes extending from its other end for mounting on said agitator.

8. The toner cartridge according to claim 1 in which said extension has its end contacting said lower wall when said agitator is in said home position.

9. A toner cartridge comprising:

a hopper having an opening for delivering toner out of said hopper;

said hopper having a lower wall extending from a bottom of said hopper to a location substantially above the bottom of said hopper to define a bottom of said opening;

a paddle rotatable in said hopper to stir toner such that some toner will move gently toward said opening;

an exit surface to deliver toner from said hopper on the side of said lower wall opposite said hopper, said exit surface sloping downwardly during normal operation of said cartridge;

an agitator extending across said exit surface having a first pivot member on one side of said exit surface and a second pivot member on an opposite side of said exit surface;

said hopper having support pins for supporting said first pivot member and said second pivot member of said agitator to pivotally support said agitator on said hopper;

said agitator normally located at a home position proximate said exit surface except when moved by said paddle around said first pivot member and said second pivot member;

an extension on said agitator extending past said lower wall into the path of said paddle in said hopper when said paddle is rotated;

and resilient means mounted on said agitator exerting a force on said agitator to return said agitator to said home position after said agitator is moved from said home position by said paddle engaging said extension during rotation of said paddle and said paddle ceases to engage said extension.

* * * * *